US006321925B1

(12) United States Patent
Crouse et al.

(10) Patent No.: US 6,321,925 B1
(45) Date of Patent: Nov. 27, 2001

(54) MULTIPLE LAYER HINGED ENCLOSURE

(75) Inventors: Douglas N. Crouse, Flanders; Bassel H. Daoud, Parsippany; Jason A. Kay, Robbinsville; David S. Kerr, Morris Plains, all of NJ (US); Ronald Marchisin, Tobyhanna; Ivan Pawlenko, Holland, both of PA (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/768,983

(22) Filed: Jan. 23, 2001

(51) Int. Cl.[7] ..... B65D 71/00

(52) U.S. Cl. ..... 220/4.27; 220/23.86; 220/521; 220/841

(58) Field of Search ..... 220/4.27, 4.26, 220/4.22, 4.23, 23.86, 23.6, 521, 840, 841; 206/233

(56) References Cited

U.S. PATENT DOCUMENTS

| | | | | |
|---|---|---|---|---|
| 1,513,860 | * | 11/1924 | Reutter | 220/4.22 |
| 1,688,042 | * | 10/1928 | Gaess | 220/4.22 |
| 2,685,363 | * | 8/1954 | Talk et al. | 220/522 |
| 4,637,514 | * | 1/1987 | Kildea et al. | 220/4.23 |
| 6,000,572 | * | 12/1999 | Kako et al. | 220/522 |
| 6,164,442 | * | 12/2000 | Stravitz | 220/522 |

* cited by examiner

*Primary Examiner*—Joseph Moy
(74) *Attorney, Agent, or Firm*—David L. Davis

(57) ABSTRACT

A multiple layer hinged enclosure utilizes two sets of parallel hinge pins to be able to stack as many layers as desired. An outer set of hinge pins is utilized by the cover and an inner set of hinge pins is utilized by intermediate layers to form an offset "shingle"effect.

5 Claims, 3 Drawing Sheets

MULTIPLE LAYER HINGED ENCLOSURE

BACKGROUND OF THE INVENTION

This invention relates to wiring enclosures and, more particularly, to a multiple layer hinged enclosure which is of modular construction to accommodate any desired number of layers.

Where telephone wires enter a building, there is usually provided an enclosure, called a building entrance box, which provides an interface between a signal transmission media cable entering a building and wires extending through the building to input jacks at various locations in the building. Such a box typically is provided in multiple layers, with the various layers being hinged one to the other so that every layer can be made accessible. It would be desirable to have such layers constructed in modular form so that any desired number of layers can be added where required.

It would also be desirable to have all the layers of such a box, or enclosure, hinged along the same side so that the wiring between layers does not have to extend "back and forth"across the layers.

SUMMARY OF THE INVENTION

The present invention provides a multiple layered hinged enclosure comprising a base section, at least one intermediate section and a cover section. The base section has a side wall and two sets of first and second parallel axially offset hinge pins mounted to the side wall. The first hinge pins of the two sets are co-linear to each other and the second hinge pins of the two sets are co-linear to each other. Each intermediate section has two co-linear hinge members adapted to each engage the first hinge pin within a respective set of hinge pins, and two sets of first and second parallel axially offset hinge pins spaced the same as the two sets of first and second hinge pins of the base section. The cover section has two co-linear hinge members adapted to each engage the second hinge pin within a respective set of hinge pins.

In accordance with an aspect of this invention, each hinge member is formed with a snap-fit feature to engage a respective hinge pin.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
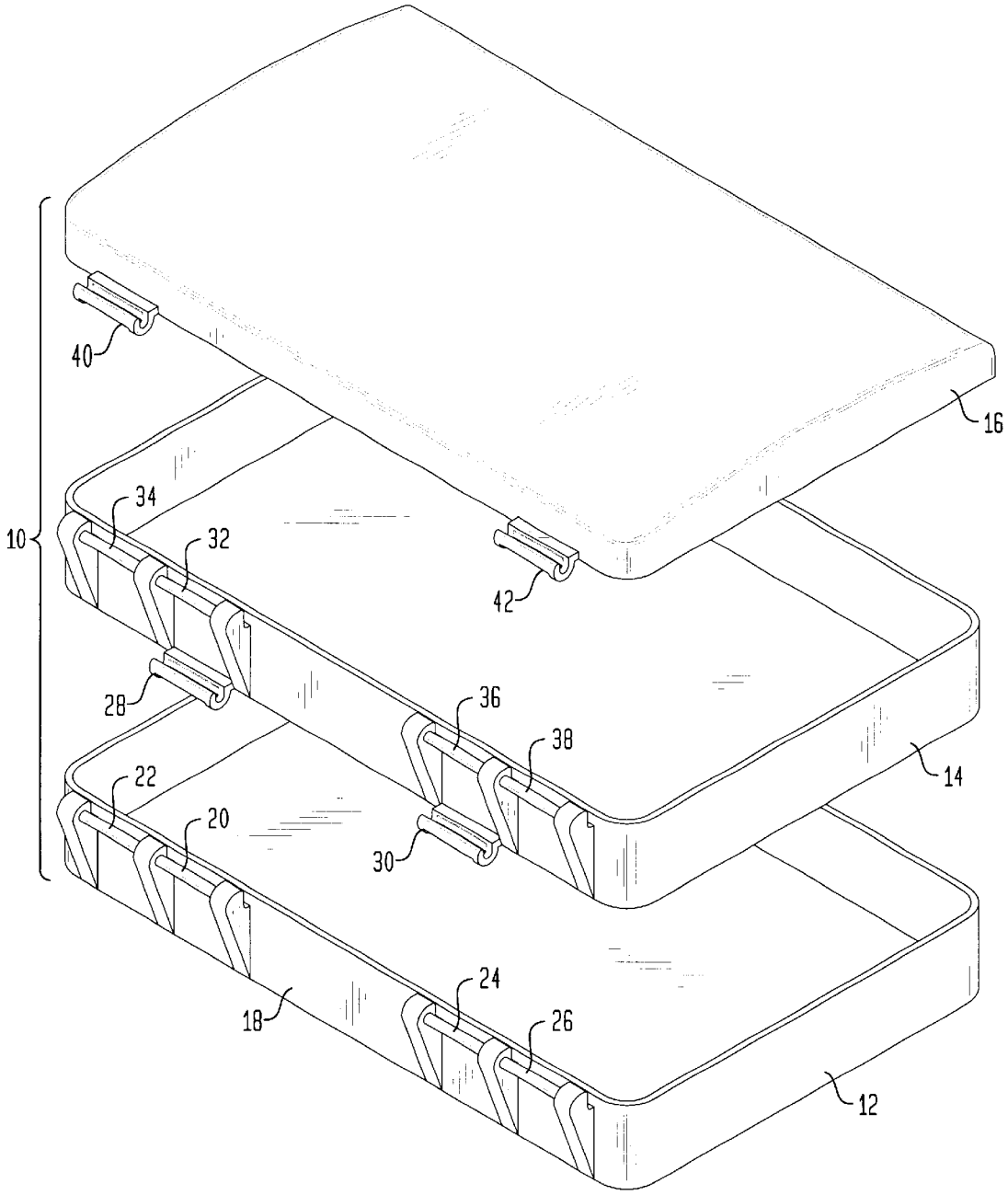
FIG. 1 is an exploded perspective view schematically illustrating an enclosure constructed in accordance with the principles of this invention.

FIG. 1 illustrates a three layer hinged enclosure, designated generally by the reference numeral 10 and constructed according to the present invention. The enclosure 10 includes a base section 12, an intermediate section 14, and a cover section 16. As shown, the base section 12 includes a side wall 18 on which are mounted a first set of hinge pins 20, 22 which are axially offset one from the other, and a second set of hinge pins 24, 26 which are axially offset one from the other. The first set of hinge pins 20, 22 is parallel to the second set of hinge pins 24, 26. The first hinge pins 20, 24 of the two sets are co-linear to each other and the second hinge pins 22, 26 of the two sets are co-linear to each other. Illustratively, all four of the hinge pins 20, 22, 24, 26 are co-linear to each other.

The intermediate section 14 has two co-linear hinge members 28, 30 which are adapted to each engage the first hinge pin 20, 24 within a respective set of the hinge pins of the base section 12. The hinge members 28, 30 are formed with a snap-fit feature to engage the hinge pins 20, 24. Illustratively, as shown in FIG. 1, the hinge members 28, 30 are adjacent the bottom of the intermediate section 14 so that the intermediate section 14 can be stacked on top of the base section 12. The intermediate section 14 is further formed with two sets of first and second parallel axially offset hinge pins 32, 34, 36, 38 which are spaced the same as the two sets of first and second hinge pins 20, 22, 24, 26 of the base section 12.

Figure 2:
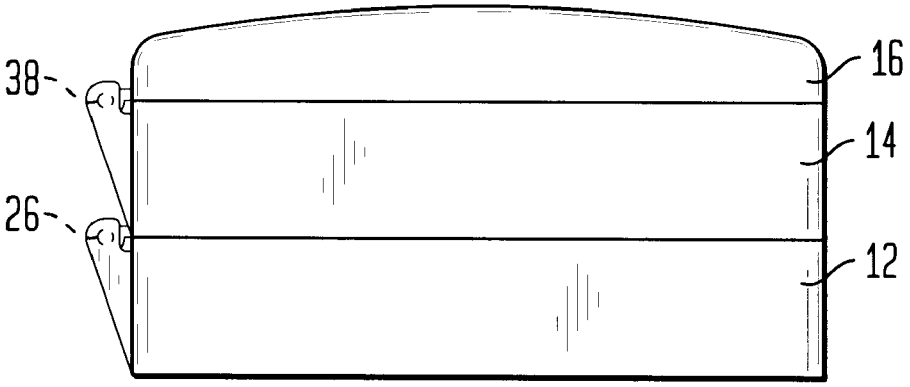
FIG. 2 is a side view schematically depicting a first configuration of a multiple layered hinged enclosure according to the present invention.

The cover section 16 has two co-linear hinge members 40, 42 which are adapted to each engage a second hinge pin 20 or 32, and 24 or 36, respectively, within a respective set of hinge pins. Like the hinge members 28, 30, the hinge members 40, 42 are formed with a snap-fit feature to engage respective hinge pins. Thus, as shown in FIG. 2, the base section 12, the intermediate section 14 and the cover section 18 may be stacked to form a multiple layer hinged enclosure wherein all of the hinging takes place along the same side.

Figure 3:
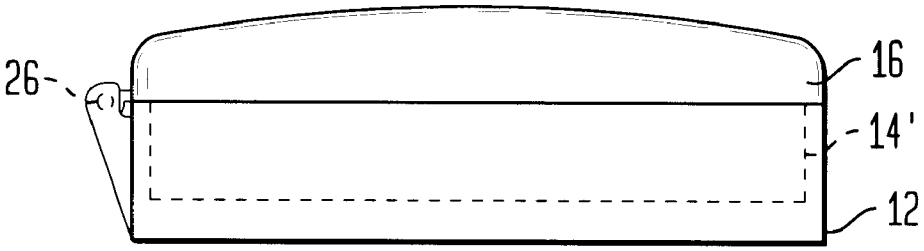
FIG. 3 is a side view schematically depicting a second configuration of a multiple layered hinged enclosure according to the present invention.

Sometimes it is desired to have a multiple layer hinged enclosure where an intermediate section is nested within a lower section. According to the present invention, this is accomplished by altering the intermediate section so that there are no hinge pins 32, 36 and the hinge members 28, 30 are positioned near the upper edge of the intermediate section. Thus, as shown in FIG. 3, the modified intermediate (or auxiliary) section 14' is hingedly secured to the hinge pins 20, 24 of the base section 12 and the cover member 16 is hingedly secured to the hinge pins 22, 26 of the base section 12.

Figure 4:
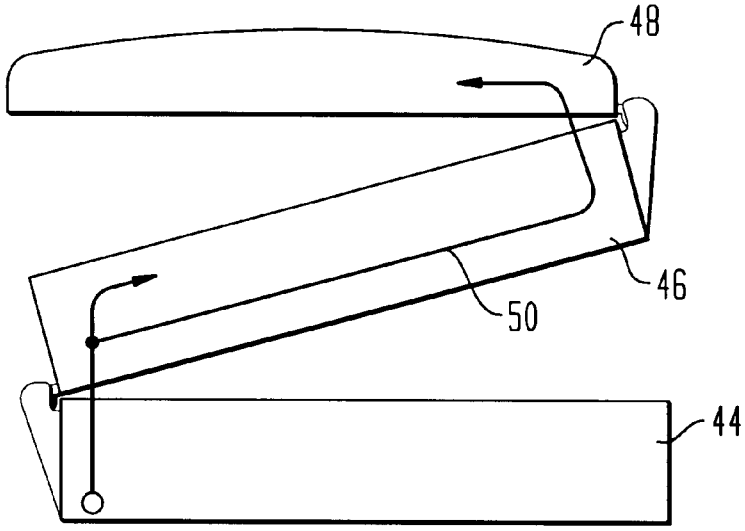
FIG. 4 (PRIOR ART)
FIG. 4 schematically illustrates a wire path with a prior art multiple layer hinged enclosure.

The aforedescribed arrangement is advantageous when compared with multiple layer hinged enclosures according to the prior art wherein the hinges alternate side-to-side. Thus, as shown in FIG. 4, in a prior art three layer hinged enclosure having a base section 44, an intermediate section 46 and a cover section 48 hinged alternately side-to-side, the enclosure opens to a Z-shape. With this arrangement, if one wishes to run wires from the base section 44 to the cover section 48, the wires have to traverse the entire length of the intermediate section 46, as shown by the line 50.

Figure 5:
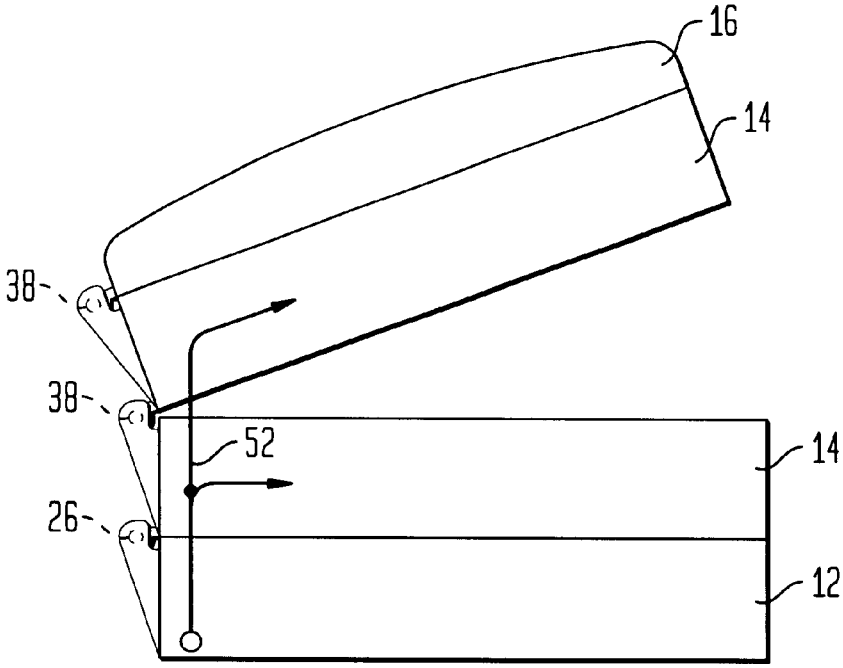
FIG. 5 schematically illustrates a wire path with a multiple layer hinged enclosure of the present invention.

According to the present invention, as illustrated in FIG. 5, the multiple layer hinged enclosure opens like a book and the wire path is much shorter, as shown by the line 52.

Accordingly, there has been disclosed an improved design of a multiple layer hinged enclosure. While an illustrative embodiment of the present invention has been disclosed herein, it will be appreciated that various adaptations and modifications to the disclosed embodiment are possible, and it is therefore intended that this invention be limited only by the scope of the appended claims.

What is claimed is:

1. A multiple layer hinged enclosure, comprising:

a base section having a side wall and two sets of first and second parallel axially offset hinge pins mounted to the side wall, wherein the first hinge pins of the two sets are co-linear to each other and the second hinge pins of the two sets are co-linear to each other;

at least one intermediate section each having two co-linear hinge members adapted to each engage the first hinge pin within a respective set of hinge pins, and two sets of first and second parallel axially offset hinge pins spaced the same as the two sets of first and second hinge pins of the base section; and a cover section having two co-linear hinge members adapted to each engage the second hinge pin within a respective set of hinge pins.

2. The enclosure according to claim 1 wherein each hinge member is formed with a snap-fit feature to engage a respective hinge pin.

3. The enclosure according to claim 1 wherein the first and second hinge pins within each set are co-linear to each other.

4. The enclosure according to claim 3 wherein:

the hinge pins on the base section are mounted adjacent an upper edge of the base section side wall;

each of the at least one intermediate section has a respective side wall;

the hinge pins of each intermediate section are mounted to the respective side wall adjacent an upper edge thereof; and the hinge members of each intermediate section are mounted to the respective side wall adjacent a lower edge thereof.

5. The enclosure according to claim 3 further comprising:

an auxiliary section sized to nest within a selected one of the base section and the at least one intermediate section, the auxiliary section having two co-linear hinge members adjacent an upper edge thereof and adapted to each engage the first hinge pin within a respective set of hinge pins.

* * * * *